US008371048B2

(12) United States Patent
Hartwick et al.

(10) Patent No.: US 8,371,048 B2
(45) Date of Patent: Feb. 12, 2013

(54) EXCAVATION MACHINE WITH AUTO REVERSE

(75) Inventors: Ty Hartwick, Pella, IA (US); Casey Dean Berg, Oskaloosa, IA (US); Oleg Khalamendik, Pella, IA (US); Karl D. Maasdam, Pella, IA (US); Joseph W. Nelson, Oskaloosa, IA (US)

(73) Assignee: Vermeer Manufacturing Company, Pella, IA (US)

( * ) Notice: Subject to any disclaimer, the term of this patent is extended or adjusted under 35 U.S.C. 154(b) by 310 days.

(21) Appl. No.: 12/897,504

(22) Filed: Oct. 4, 2010

(65) Prior Publication Data

US 2011/0078929 A1 Apr. 7, 2011

Related U.S. Application Data

(60) Provisional application No. 61/301,114, filed on Feb. 3, 2010, provisional application No. 61/248,217, filed on Oct. 2, 2009.

(51) Int. Cl.
*E02F 5/00* (2006.01)

(52) U.S. Cl. ..... 37/195

(58) Field of Classification Search ..... 37/195, 37/347, 348, 352–362, 364, 365, 189; 172/2–11; 299/75, 34.01, 34.02, 82.1; 405/174, 180
See application file for complete search history.

(56) References Cited

U.S. PATENT DOCUMENTS

| | | | | |
|---|---|---|---|---|
| 4,908,967 | A | 3/1990 | Leece | |
| 5,090,141 | A | 2/1992 | Hall | |
| 5,311,683 | A | 5/1994 | Camilleri | |
| 5,465,511 | A * | 11/1995 | Umberson | 37/355 |
| 6,536,143 | B2 * | 3/2003 | Lembcke | 37/465 |
| 6,658,767 | B2 * | 12/2003 | Kelly et al. | 37/347 |
| 7,150,115 | B2 * | 12/2006 | Parker | 37/352 |
| 2001/0013182 | A1 | 8/2001 | Boyer | |
| 2005/0000123 | A1 | 1/2005 | Arzberger | |
| 2006/0059730 | A1 | 3/2006 | Parker | |

* cited by examiner

*Primary Examiner* — Robert Pezzuto
(74) *Attorney, Agent, or Firm* — Merchant & Gould P.C.

(57) ABSTRACT

The present disclosure provides an excavation machine that is configured to minimize or otherwise account for the unintended stoppage (i.e., jamming/stalling) of a digger tool. According to an embodiment of the present disclosure a machine is provided with one or more drive systems that automatically stop and reverse to avoid excavation tool jamming. The machine and methods of the present disclosure provide an efficient method and machine for excavation operations.

27 Claims, 17 Drawing Sheets

EXCAVATION MACHINE WITH AUTO REVERSE

RELATED APPLICATIONS

This application claims priority to Provisional Application No. 61/301,114 filed on Feb. 3, 2010 and Provisional Application No. 61/248,217 filed on Oct. 2, 2009, which are both incorporated by reference herein in their entirety.

TECHNICAL FIELD

The present disclosure generally relates to an excavation machine for digging, cutting, trenching, grinding, and related methods.

BACKGROUND

Excavation machines (machines with digger chains, machines with rock wheels, terrain levelers, etc.) often include an excavation tool (e.g., digger chain, cutting wheel, excavation drum, etc.) supported on a chassis. The load on the excavation tool can vary depending in part on the material that the digger tool encounters and the ground drive speed. When the load on the digger tool gradually increases (e.g., when the excavation machine moves from sandy soil to clay), an operator and/or an onboard automated speed control system can adjust the drive speed of the machine to account for the increased load on the excavation tool. However, in some situations the load on the excavation tool can change abruptly. For example, a digger chain of a trencher may encounter a tree root that causes the digger chain to jam or otherwise slow down abruptly. In such a situation the operator or automated speed control system may not be able to avoid or otherwise account for the unintended stoppage (i.e., jamming/stalling) of the excavation tool, which is undesirable as it can result in inefficient machine operations.

The present disclosure provides a trenching system and method that accounts for abrupt changes on the load encountered by the trencher attachment (e.g., boom and digger tool assembly).

SUMMARY

The present disclosure provides an excavation machine that is configured to minimize or otherwise account for the unintended stoppage (i.e., jamming/stalling) of the excavation tool. The machine and methods of the present disclosure provide for efficient excavation operations.

DETAILED DESCRIPTION

Figure 1A:
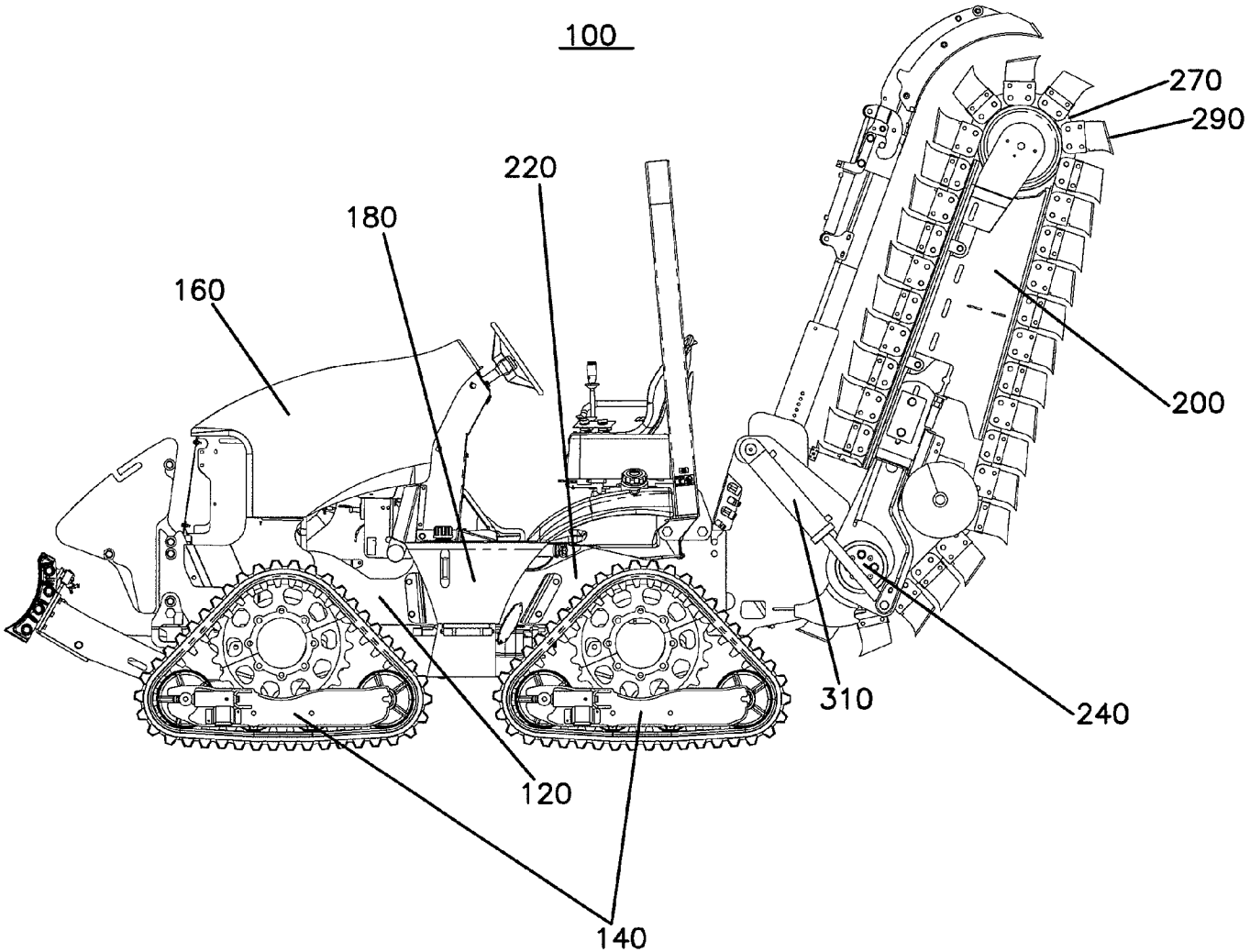
FIG. 1A is a side view of an excavation machine according to an embodiment of the present disclosure.

Referring to FIG. 1A, an excavation machine according to an embodiment of the present disclosure is shown. In the depicted embodiment the excavation machine is a trencher 100 that includes a frame 120 that is supported on a drive mechanism 140 (wheels or tracks). The frame 120 supports an engine 160, a hydraulic pump system 180, a boom 200, an electrically controlled hydrostatic ground drive system 220, and an electrically controlled hydrostatic attachment drive system 240. In the depicted embodiment the hydrostatic ground drive system and attachment drive system are electronic displacement controlled systems. It should be appreciated, however, that other types of drive systems and/or configurations are possible. In the depicted embodiment, the hydrostatic attachment drive system rotates a digging tool in the form of a trenching chain 270 about the boom 200. The chain 270 functions as a carrier for a plurality of cutting teeth 290 in a rotational cutting motion about the boom 200. A cylinder 310 is used to raise and lower the boom 200.

Figure 1B:
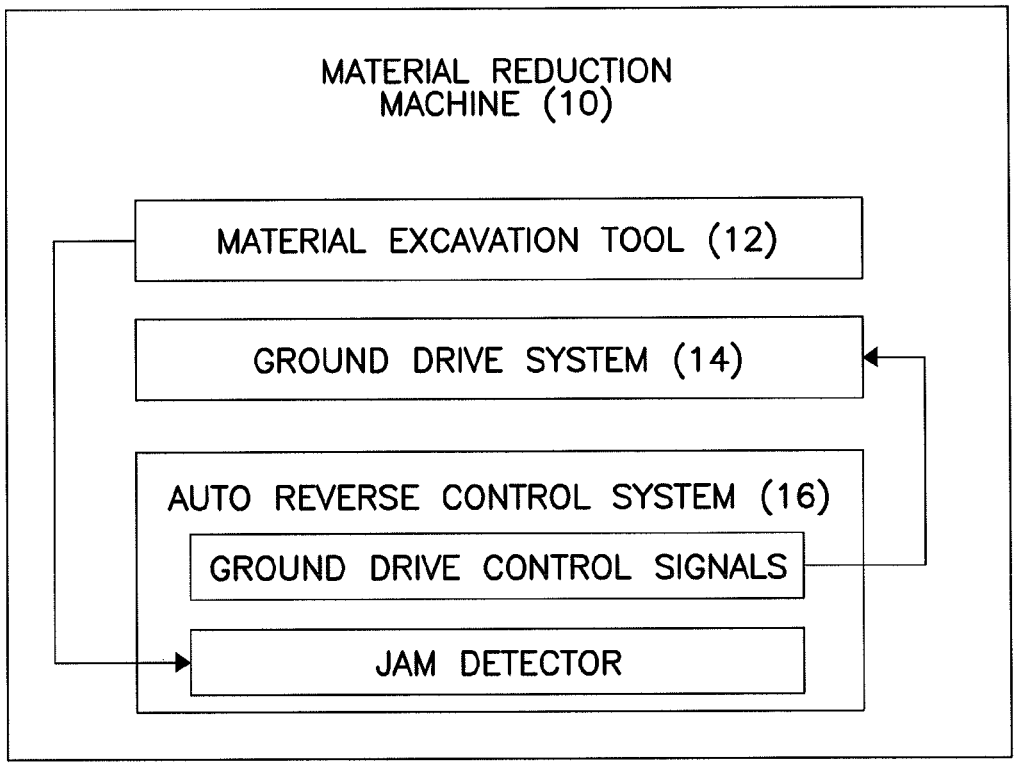
FIG. 1B is a schematic illustration of an excavation machine according to an embodiment of the present disclosure.
Figure 2:
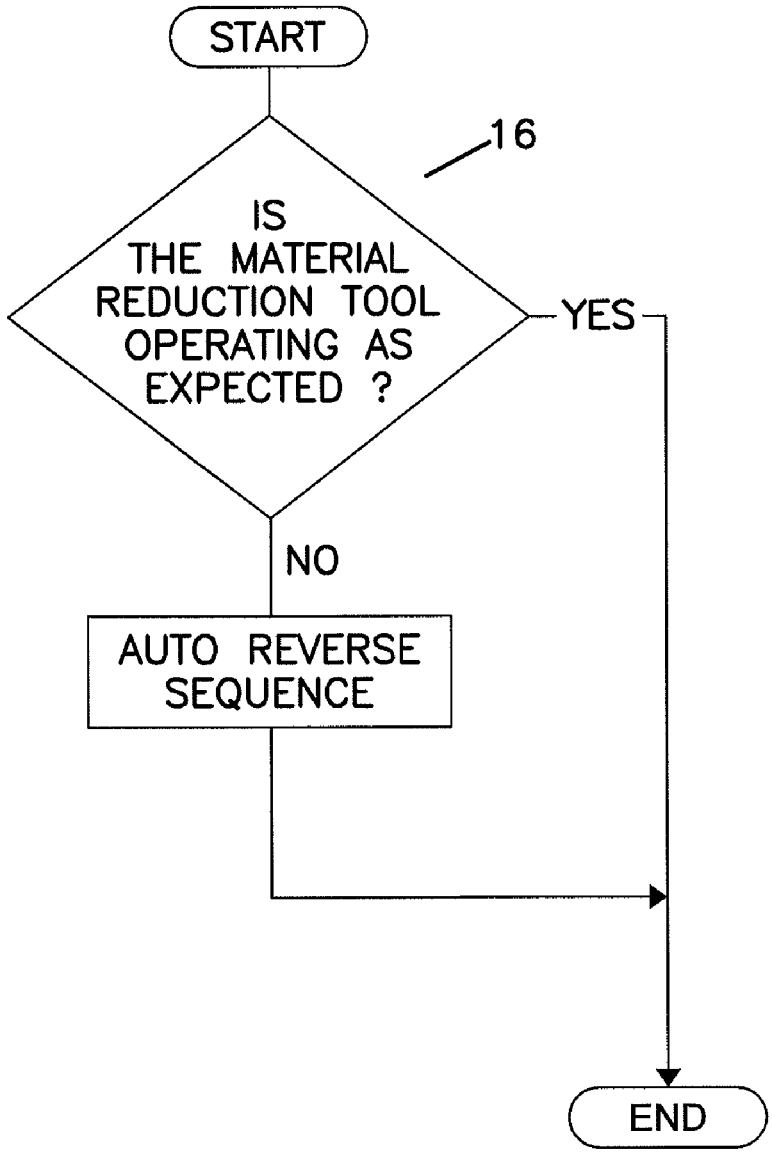
FIG. 2 is a block diagram of an excavation machine control system.

Referring to FIG. 1B, an excavation machine 10 according to an embodiment of the present disclosure is shown. The excavation machine 10 includes an excavation tool 12, a ground drive system 14, and an auto reverse control system 16. In the depicted embodiment the auto reverse control system 16 is configured to automatically cause the ground drive system 14 to reverse the direction of the excavation machine 10 when the excavation tool 12 has jammed or when a jam is imminent. The auto reverse control system can alternatively or additionally be configured to automatically reverse the direction of the excavation tool 12.

According to the present disclosure, an excavation machine is any machine that includes an excavation tool and a ground drive system. An excavation tool can be any device that is configured to dig, cut, grind, break, or reduce materials (e.g., digger chains on trenching equipment, rock wheels, drums on terrain levelers, vibratory plows, etc.). A ground drive system can be any drive system that is configured to move a machine in a forward and backward direction relative to the ground (e.g., a pair of tracks driven by hydraulic motors, rubber tires driven by hydraulic motors, rubber tires driven by a diesel engine via a transmission, etc.).

In the depicted embodiment, the auto reverse control system 16 is configured to determine when the excavation tool 12 is not operating as expected, and control the ground drive system accordingly. In the depicted embodiment, the auto reverse control system 16 determines when the excavation tool is, or is about to be, running at a speed (e.g., a working speed of a plow relative to the ground, the rotational speed of a hydraulic motor that drives a digger chain, etc.) that is below optimal. For example, the auto reverse control system 16 is configured to determine when the excavation tool has jammed (i.e., stopped), when the excavation tool is about to jam, and/or when the speed of the excavation tool falls below a desired level or when the machine slows down too much or stops. When an auto reverse triggering condition is determined, the auto reverse control system 16 triggers an auto reverse sequence that results in automatic reversal of the ground drive system 14 and/or excavating tool.

In the depicted embodiment the system is also configured to reverse the rotation of the digger tool (e.g., digger chain, rock wheel, etc.) and/or reverse the ground drive if certain conditions are met. In particular, whether the response includes reversing the drive and/or reversing the attachment depends in part on the type of attachment that is being used. For example, if the attachment is a trenching attachment (e.g., a boom with a digger chain or rock wheel), the attachment drive would likely be configured to be reversed and the ground drive would also be reversed as part of the stall avoidance response. However, if the attachment type is a plow, the system may stop the forward drive and the attachment drive, but may not reverse the ground drive and the attachment drives. In addition, if the system determines a monitored parameter will not drop below the predetermined lower limit, but will drop below a particular level (i.e., an intermediate value), then the system may be configured to automatically slow the forward movement of the machine.

According to the present disclosure, there are a number of ways that the auto reverse control system 16 of the depicted embodiment can be configured to detect the auto reverse triggering condition. In one embodiment, the speed of the excavation tool is monitored via a speed sensor. When the speed drops below a set value (e.g., 0.0 rotations per minute, 10 rotations per minute, 60 rotations per minute, one foot forward per second, etc.), the auto reverse control system 16 triggers the auto reverse sequence. In another embodiment, the auto reverse control system 16 triggers the auto reverse sequence when the deceleration of the excavation tool exceeds a certain magnitude.

In other embodiments, the auto reverse control system 16 of the depicted embodiment can be configured to detect the auto reverse triggering condition based on the pressure in a hydraulic system operably connected to the excavation tool. For example, the pressure in a hydraulic cylinder that holds a plow in place can be monitored and the auto reverse control system 16 can be configured to trigger an auto reverse sequence when the pressure exceeds a particular value. Alternatively, the pressure in a hydraulic line to, from, or in a hydraulic motor that drives a digger chain can be monitored and the auto reverse control system 16 can be configured to trigger an auto reverse sequence when the pressure exceeds a particular value.

In other embodiments, the flow rate of hydraulic fluid to, from, or in a motor that drives an excavation tool can be monitored and the auto reverse control system 16 can be configured to trigger an auto reverse sequence when the flow rate decreases to below a certain value or when the flow rate decreases at a rate greater than a certain value.

In other embodiments, the speed of an engine that powers the excavation tool can be monitored. In such an embodiment the auto reverse control system 16 can be configured to trigger an auto reverse sequence when the engine speed decreases to below a certain value or when the engine speed decreases at a rate greater than a certain value.

The various ways that the auto reverse control system 16 of the depicted embodiment can be configured to detect the auto reverse triggering condition are described in greater detail below.

Figure 3:
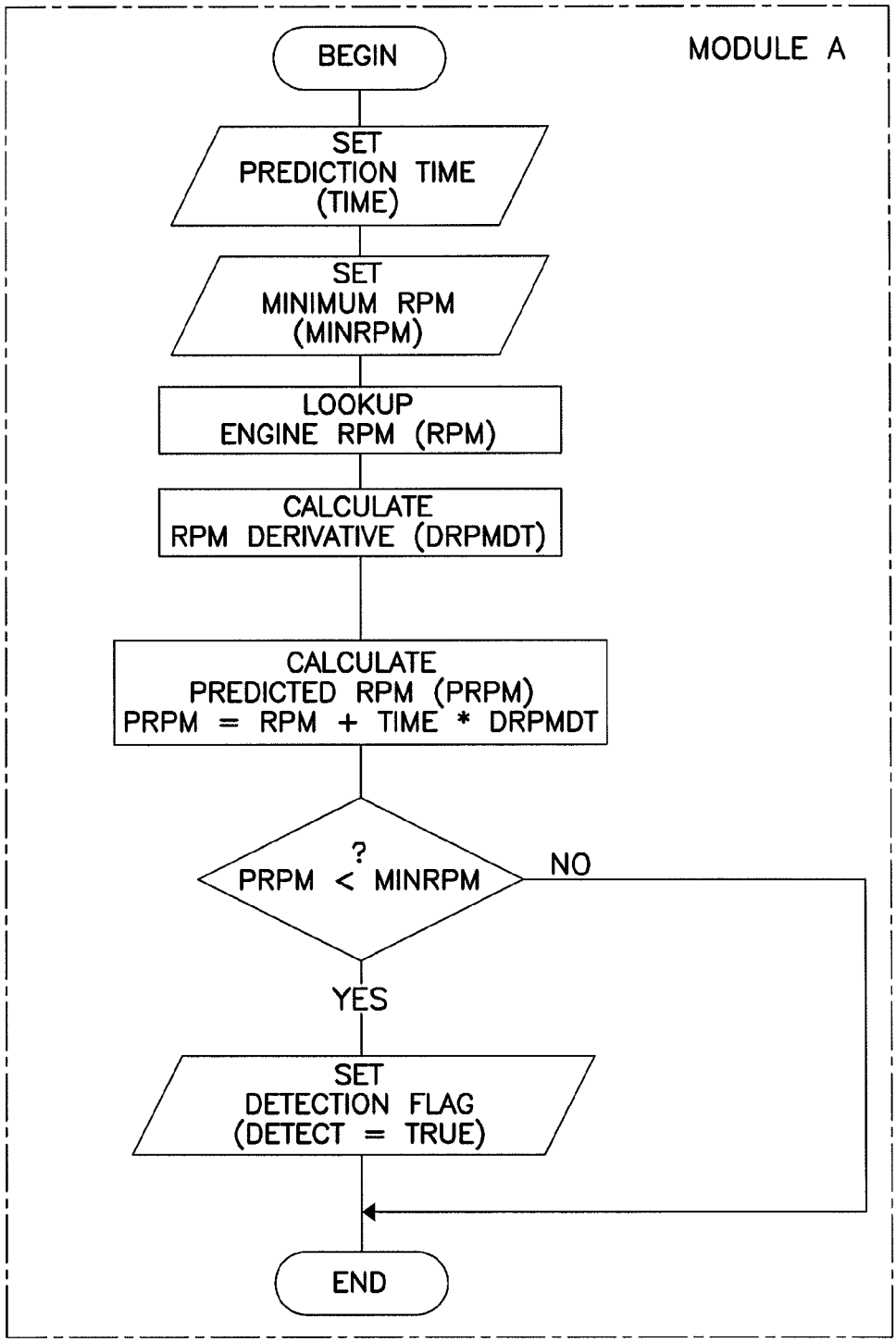
FIG. 3 is a block diagram of an engine speed based auto reverse triggering condition according to an embodiment of the present disclosure.

Referring to FIG. 3, an embodiment of the excavation machine is configured to detect the auto reverse triggering condition based on monitoring engine speed (engine RPM). In the depicted embodiment the engine speed is related to the excavation speed in that when the excavation speed goes to zero or drops fast due to a jam or impending jam, the engine speed decreases quickly. This relationship can be a result of various machine configurations including, for example, configurations where the excavation tool is driven by a hydraulic system (e.g., pump and motor) and the overflow pressure is set high enough such that when the excavation tool jams or is about to jam, the pressure is allowed to increase to a point that engine speed is drawn down.

Still referring to FIG. 3, in the depicted embodiment the system is configured to monitor the engine speed by checking the engine speed at set prediction times (TIME), for example, once every second, and determining if the engine speed is going to drop below a minimum speed (MINRPM). The system is configured to check/lookup the engine speed (RPM), calculate the deceleration/acceleration of the engine speed (DRPMDT), and calculate the predicted engine speed (PRPM). If the predicted engine speed is below the set minimum speed (MINRPM), then the auto reverse triggering condition is detected (detect flag is set to true). If the predicted engine speed is greater than or equal to the set minimum speed (MINRPM), then the auto reverse triggering condition is not detected (detect flag is set to false). It should be appreciated that many other variations of the engine speed based auto reverse triggering system are possible. For example, see U.S. Patent Application No. 61/248,217 filed on Oct. 2, 2009, which is incorporated herein by reference in its entirety.

In some embodiments the excavation machine is configured such that the engine speed is not a good parameter to monitor to detect jams or impending jams of an excavation tool. For example, the excavation tool can be driven by a hydraulic system wherein an overflow pressure is set low enough so that the engine speed does not significantly drop even when the excavation tool is jammed. Alternatively, the excavation tool can have an engine that is large enough such that its speed is unaffected by the jam of an excavation tool. In such embodiments other parameters may be monitored to detect the auto reverse trigger conditions.

Figure 4:
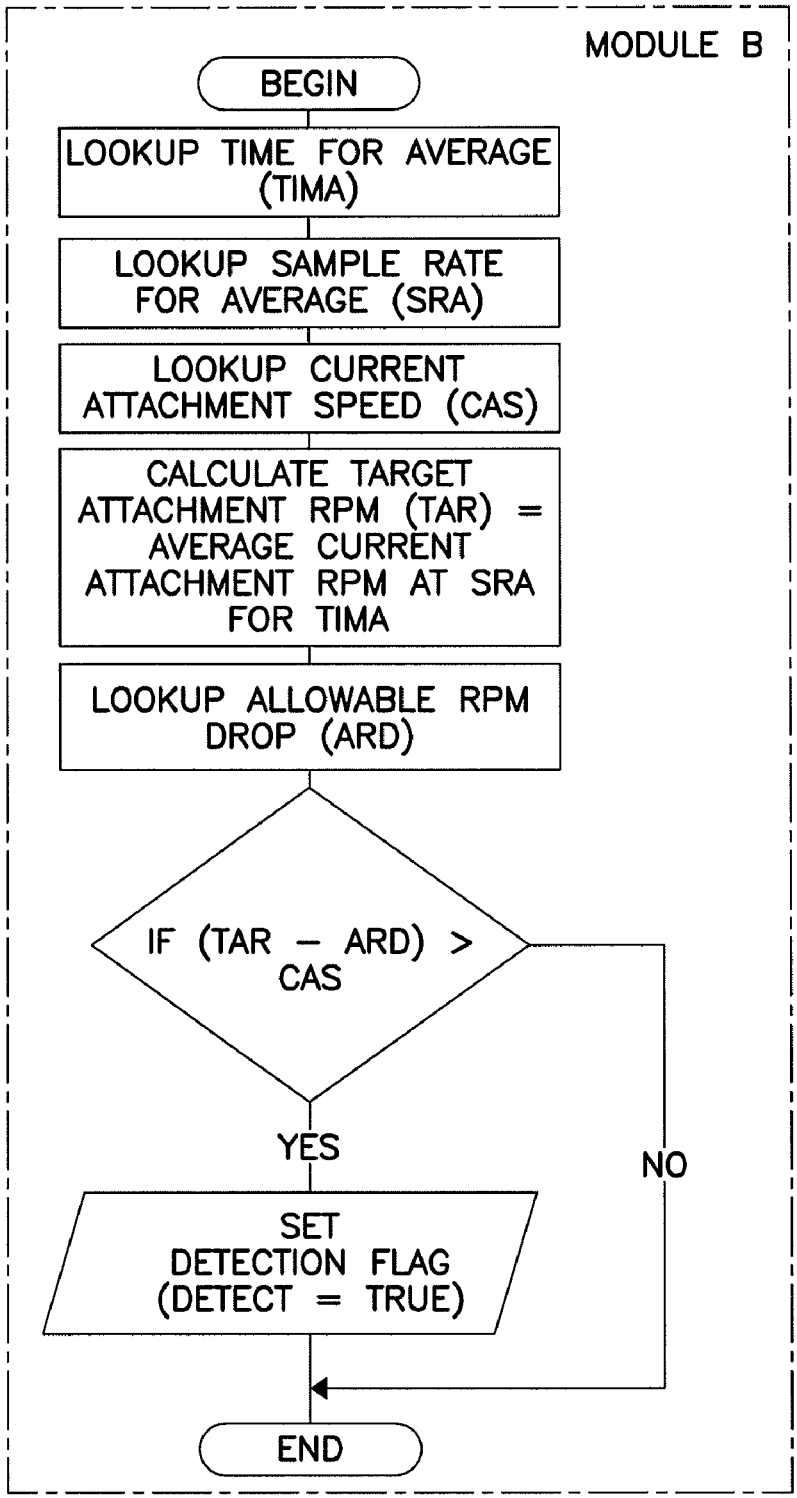
FIG. 4 is a block diagram of an excavation tool speed based auto reverse triggering condition according to an embodiment of the present disclosure.

Referring to FIG. 4, an embodiment of the excavation machine is configured to detect the auto reverse triggering condition based on monitoring excavation tool speed (e.g., attachment speed). The speed of the excavation tool can be indicative of a jam or a pre jam condition. In particular, when the excavation speed goes to zero, the excavation tool is likely jammed, and when the excavation speed decreases at a high rate, the excavation tool may be about to jam.

In the depicted embodiment, the system is configured to set up a look up time period (TIMA) in which the speed of the excavation tool will be sampled at a particular rate (SRA) to calculate the expected or target excavation tool speed (TAR). The system is configured to determine (e.g., look up) an allowable speed drop (ARD) based on the target excavation tool speed (TAR) and compare the current excavation tool speed (CAS) to the expected excavation tool speed (TAR) less the allowable drop in speed (ARD). If the current excavation tool speed (CAS) is less than the excavation tool speed (TAR) less the allowable drop in speed (ARD), the auto reverse trigger condition is detected (the detection flag is set to true); otherwise, the auto reverse trigger condition is not detected.

For example, the look up time (TIMA) could be 30 seconds, the rate (SRA) could be 60 samples per minute, and the expected excavation speed (SRA) based on the sampling could be 120 rotations per minute. The allowable speed drop (ARD) corresponding to 120 rotations per minute could be 60 rotations per minute. If the current excavation tool speed (CAS) is less than 60 rotations per minute, the system will detect the auto reverse trigger condition; otherwise, the auto reverse trigger condition is not detected. It should be appreciated that many other variations of the excavation speed based auto reverse triggering system are possible.

Figure 5:
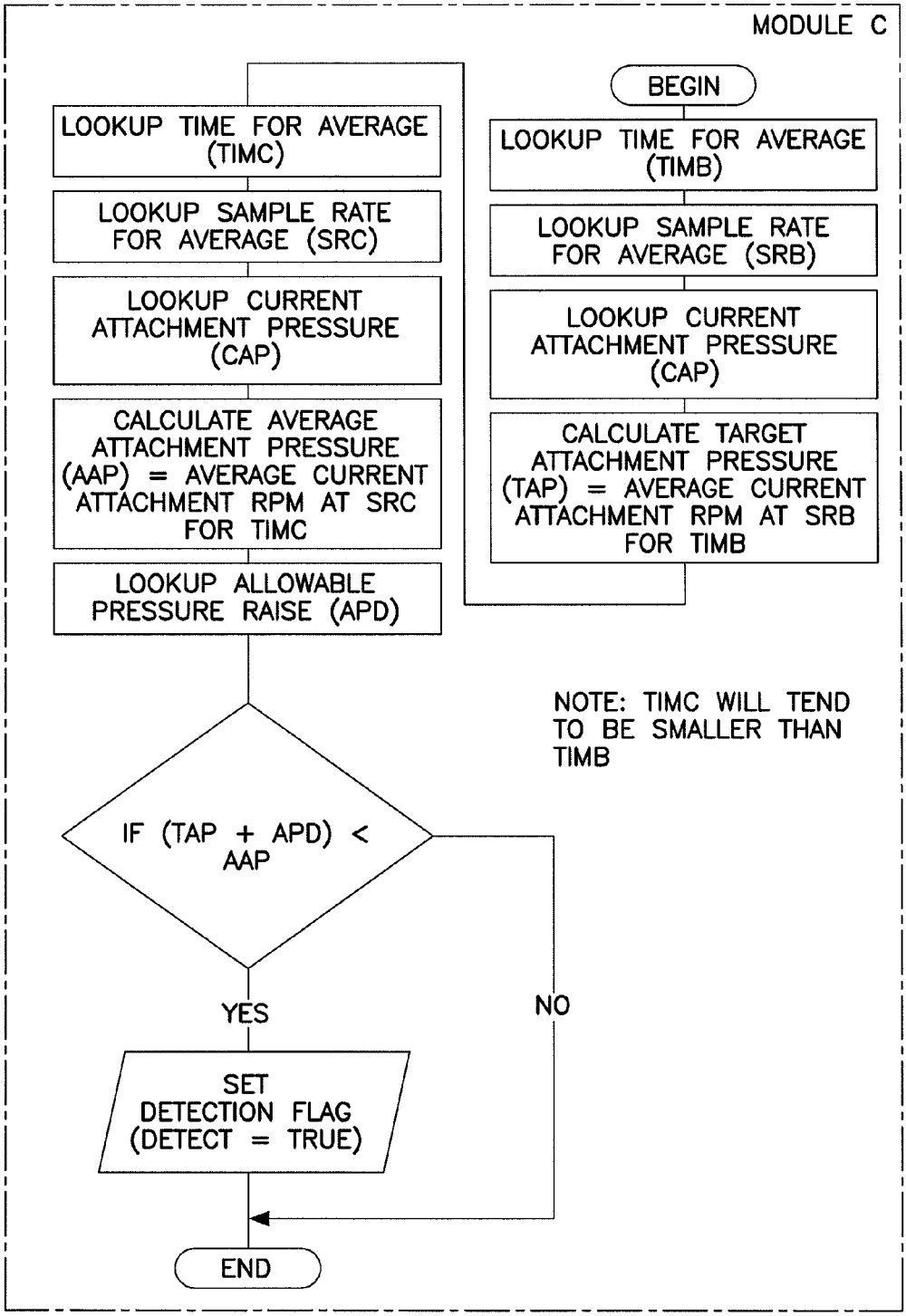
FIG. 5 is a block diagram of a pressure based auto reverse triggering condition according to an embodiment of the present disclosure.

Referring to FIG. 5, an embodiment of the excavation machine is configured to detect the auto reverse triggering condition based on monitoring a hydraulic pressure that drives the excavation tool. In the depicted embodiment hydraulic pressure can be indicative of a jam or a pre jam condition. In particular, when the pressure exceeds a certain overflow value, the excavation tool is likely jammed, and when the pressure increases at a high rate, the excavation tool may be about to jam.

In the depicted embodiment, the system is configured to set up a look up time period (TIMB) in which the hydraulic pressure in the system that drives the excavation tool will be sampled at a particular rate (SRB) to calculate the expected or target pressure (TAP). The system is configured to determine (e.g., look up) an allowable pressure increase (APD) based on the target pressure (TAP) and compare the average pressure over a shorter time interval (AAP) to the expected pressure (TAP) plus the allowable drop in speed (APD). If the average pressure (AAP) over the shorter time interval (TIMC) sampled at a rate (SRC) is greater than expected pressure (TAP) plus the allowable increase (ARD), the auto reverse trigger condition is detected (the detection flag is set to true); otherwise, the auto reverse trigger condition is not detected. It should be appreciated that many other variations of the depicted pressure based auto reverse triggering system are possible. For example, in an alternative embodiment the current pressure at a particular time (CAP) could be used in place of the pressure (AAP) over the short time interval (TIMC) sampled at a rate (SRC).

Figure 6:
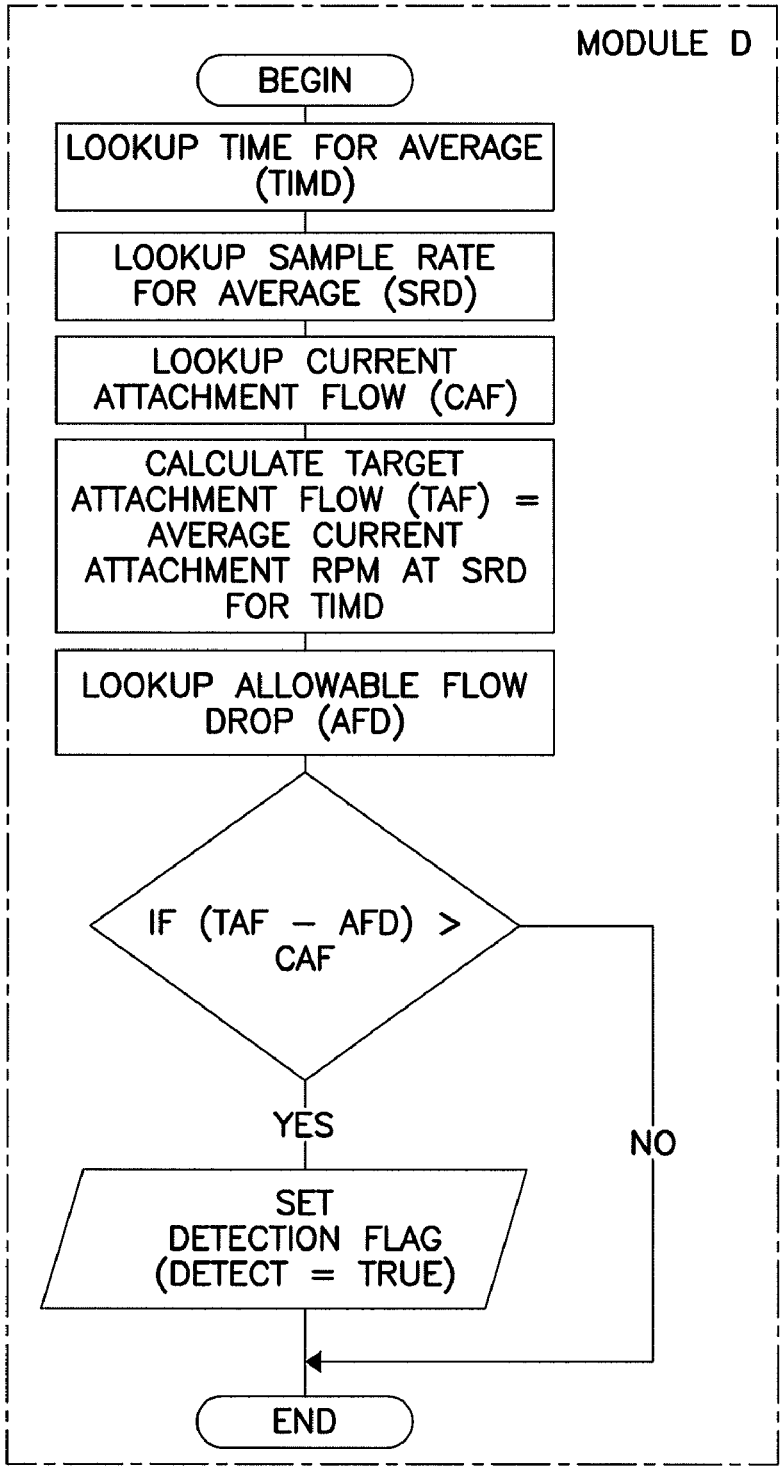
FIG. 6 is a block diagram of a flow based auto reverse triggering condition according to an embodiment of the present disclosure.

Referring to FIG. 6, an embodiment of the excavation machine is configured to detect the auto reverse triggering condition based on monitoring a hydraulic flow to or from a motor that drives the excavation tool. In the depicted embodiment hydraulic flow can be indicative of a jam or a pre jam condition. In particular, when the flow decreases below a certain rate value, the excavation tool is likely jammed, and when the flow rate decrease is greater than a certain value, the excavation tool may be about to jam.

In the depicted embodiment, the system is configured to set up a look up time period (TIMD) in which the hydraulic flow in the system that drives the excavation tool will be sampled at a particular rate (SRD) to calculate the expected or target flow (TAF). The system is configured to determine (e.g., look up) an allowable flow drop (AFD) based on the target flow (TAF) and compare the current flow (CAF) to the target flow (TAF) minus the allowable drop in flow (AFD). If the current flow (CAF) is less than target flow (TAF) minus the allowable drop (AFD), the auto reverse trigger condition is detected (the detection flag is set to true); otherwise, the auto reverse trigger condition is not detected. It should be appreciated that many other variations of the depicted flow based auto reverse triggering system are possible.

Figure 7:
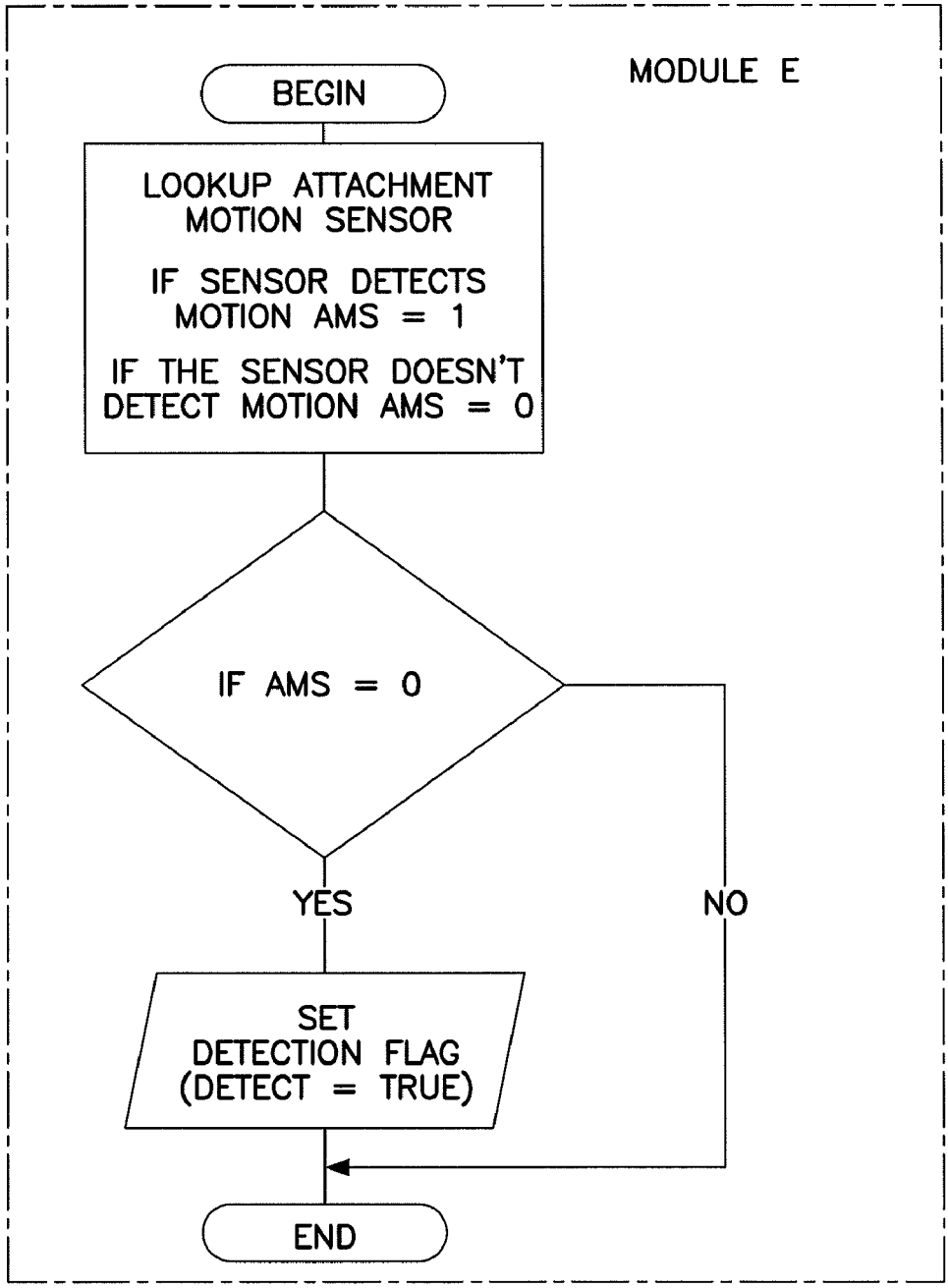
FIG. 7 is a block diagram of an excavation tool motion based auto reverse triggering condition according to an embodiment of the present disclosure.

Referring to FIG. 7, an embodiment of the excavation machine is configured to detect the auto reverse triggering condition based on monitoring whether the excavation tool is in motion. The depicted embodiment is a simplified version of the excavation speed based system shown in FIG. 4. In the depicted embodiment the system is configured to monitor whether the excavation tool is in motion. If the excavation tool is not in motion (when it should be in motion), the auto reverse trigger condition is detected (the detection flag is set to true); otherwise, the auto reverse trigger condition is not detected. It should be appreciated that many other variations of the excavation speed motion based auto reverse triggering system are possible (e.g., see FIG. 4).

Figure 8:
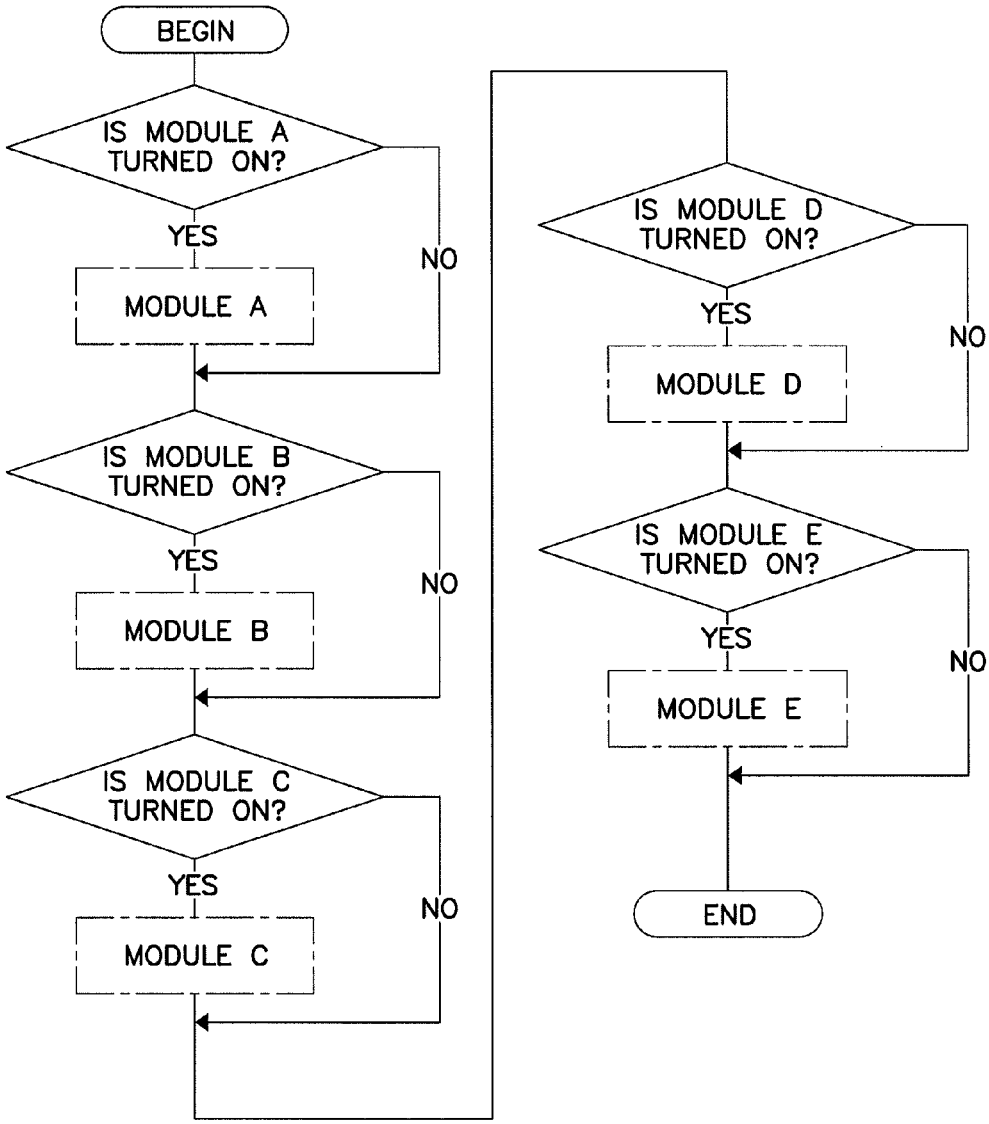
FIG. 8 is a block diagram of a multi-parameter based auto reverse triggering condition according to an embodiment of the present disclosure.

Referring to FIG. 8, it should be appreciated that any one of the above configurations for triggering the auto reverse system can be used alone or in combination with another configuration. FIG. 8 illustrates an embodiment wherein all of the above trigger conditions (engine speed based condition, excavation speed based condition, pressure based condition, flow based condition, and motion based condition) need to be met for the auto reverse trigger to be set to true.

Once the auto reverse triggering condition is detected, the auto reverse sequence is initiated. In the depicted embodiment, one step in the auto reverse sequence is reversing the ground drive system. In some embodiments the ground drive system is reversed a set distance and/or time before resuming forward motion. The distance or time can be set based on estimation of the distance or time that is sufficient to free a jam and/or lessen the load on the excavation tool thereby allowing the speed of the tool to increase. For example, in one embodiment the system is configured to reverse six inches and wait two seconds before resuming forward motion.

Figure 9:
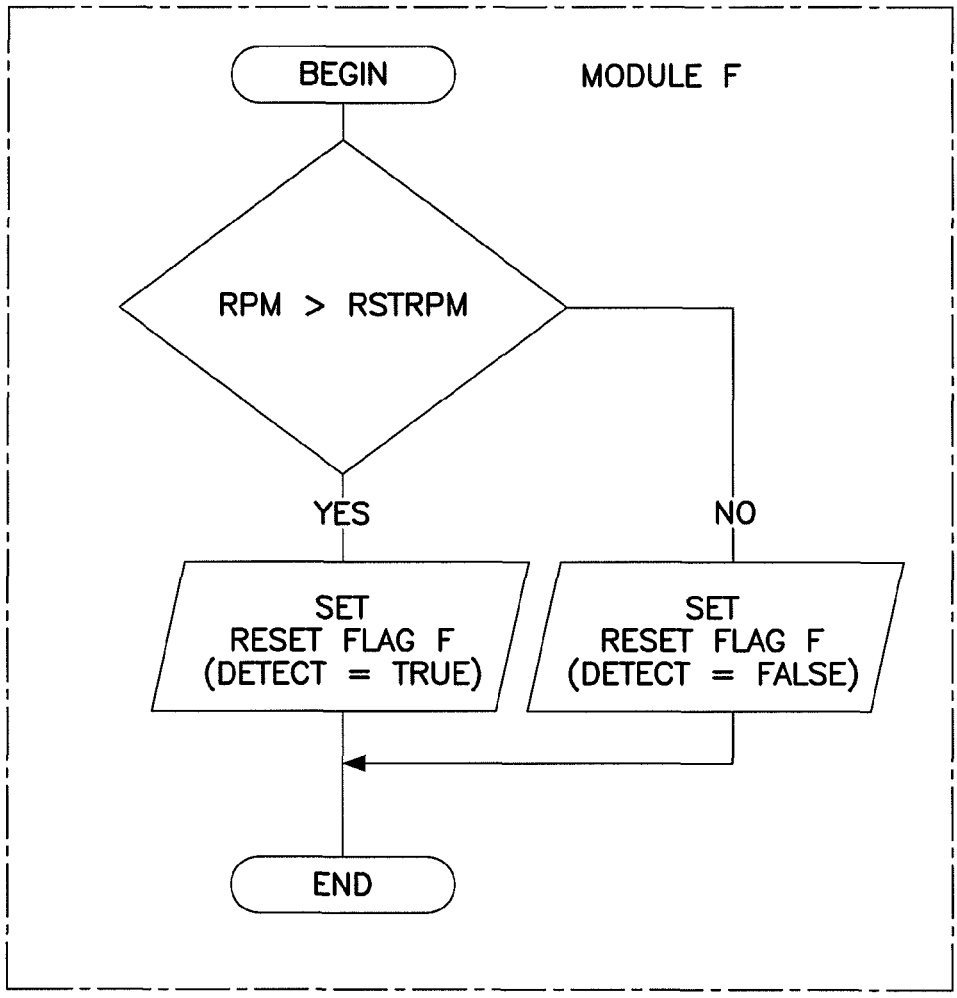
FIG. 9 is a block diagram of an engine speed based auto reverse exit condition according to an embodiment of the present disclosure.

In other embodiments the ground drive system does not resume forward motion until the parameter (engine speed, excavation speed, pressure, flow, etc.) that triggers the auto reverse sequence is no longer at a state that would result in the trigger of the auto reverse sequence. For example, FIG. 9 illustrates a system wherein the system does not resume forward motion (e.g., continues to reverse and/or waits stationary) until the engine speed (RPM) exceeds recovery speed (RSTRPM). Once the engine speed (RPM) exceeds the recovery speed (RSTRPM), the auto reverse triggering sequence is set to true. Until then, the system is not reset and forward motion is not resumed to allow the engine of the excavation machine time to recover.

Figure 10:
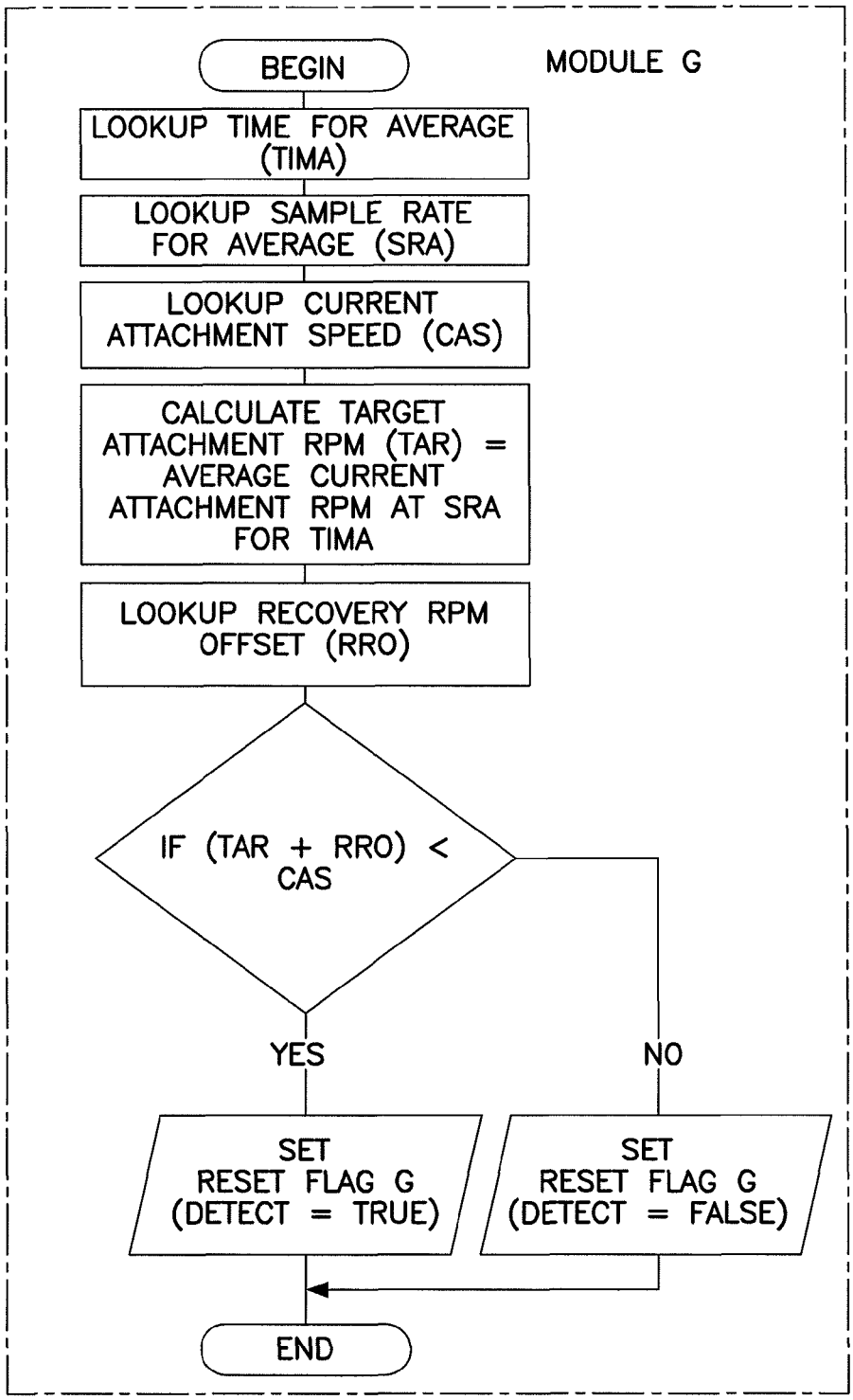
FIG. 10 is a block diagram of an excavation tool speed based auto reverse exit condition according to an embodiment of the present disclosure.

Referring to FIG. 10, an embodiment wherein forward motion is resumed based on the attachment speed is shown. In the depicted embodiment, forward motion is resumed only when the attachment speed exceeds an estimated recovery speed. In the depicted embodiment, the system is configured to set up a look up time period (TIMA) in which the speed of the excavation tool will be sampled at a particular rate (SRA) to calculate the expected or target excavation tool speed (TAR). The system is configured to determine (e.g., look up) a recovery speed (RRO) based on the target excavation tool speed (TAR) and compare the current excavation tool speed (CAS) to the expected excavation tool speed (TAR) plus the recovery speed (RRO). If the current excavation tool speed (CAS) is greater than the reduction tool speed (TAR) plus the recovery speed (RRO), the auto reverse sequence is reset and the forward motion of the excavation tool is resumed; otherwise, the machine continues to wait for the attachment speed to increase.

For example, the look up time (TIMA) could be 30 seconds, the rate (SRA) could be 60 samples per minute, and the expected excavation speed (SRA) based on the sampling could be 60 rotations per minute. The recovery speed (RRO) corresponding to 60 rotations per minute could be 30 rotations per minute. If the current excavation tool speed (CAS) is greater than 90 rotations per minute, the system resets; otherwise, the system will continue to wait. It should be appreciated that many other variations are possible.

Figure 11:
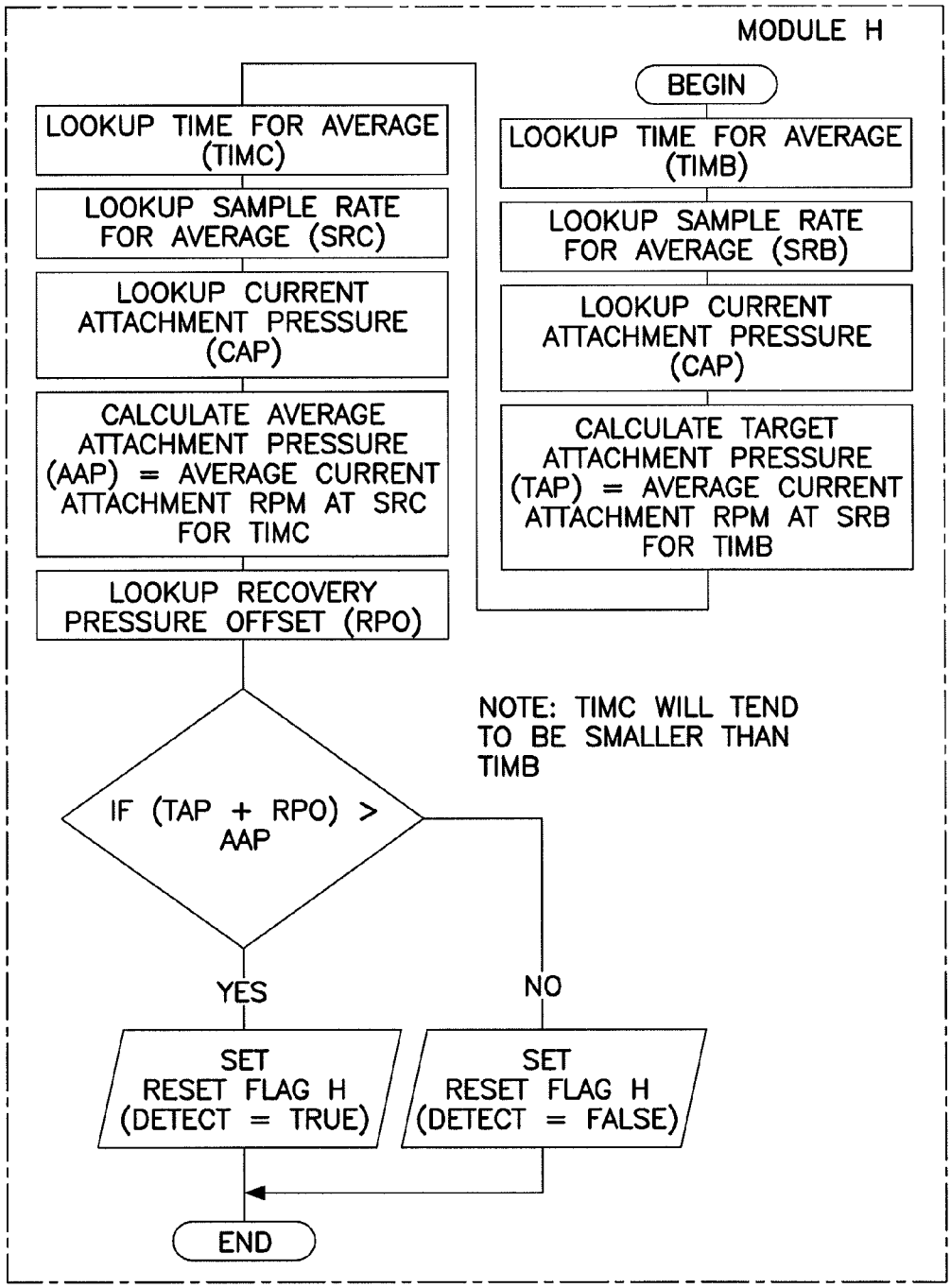
FIG. 11 is a block diagram of a pressure based auto reverse exit condition according to an embodiment of the present disclosure.

Referring to FIG. 11, the system can be configured to resume normal operations (e.g., automatically resume forward movement or enable an operator to manually control the machine to drive it forward) based on hydraulic pressure parameters. The configuration can be analogous to the configuration shown in FIG. 5 and described above. The system can have a set look up time period (TIMB) in which the hydraulic pressure in the system that drives the excavation tool will be sampled at a particular rate (SRB) to calculate the expected or target pressure (TAP). Instead of an allowable pressure increase (APD) based on the target pressure (TAP), the system determines a recovery pressure offset (RPO). If the average pressure (AAP) over the shorter time interval (TIMC) sampled at a rate (SRC) is less than expected pressure (TAP) plus the recovery pressure offset (RPO), the system is reset (Detect=true); otherwise, the system is not reset and continues to wait for recovery (absent a manual override). It should be appreciated that many other variations of the depicted pressure based auto reverse triggering system are possible.

Figure 12:
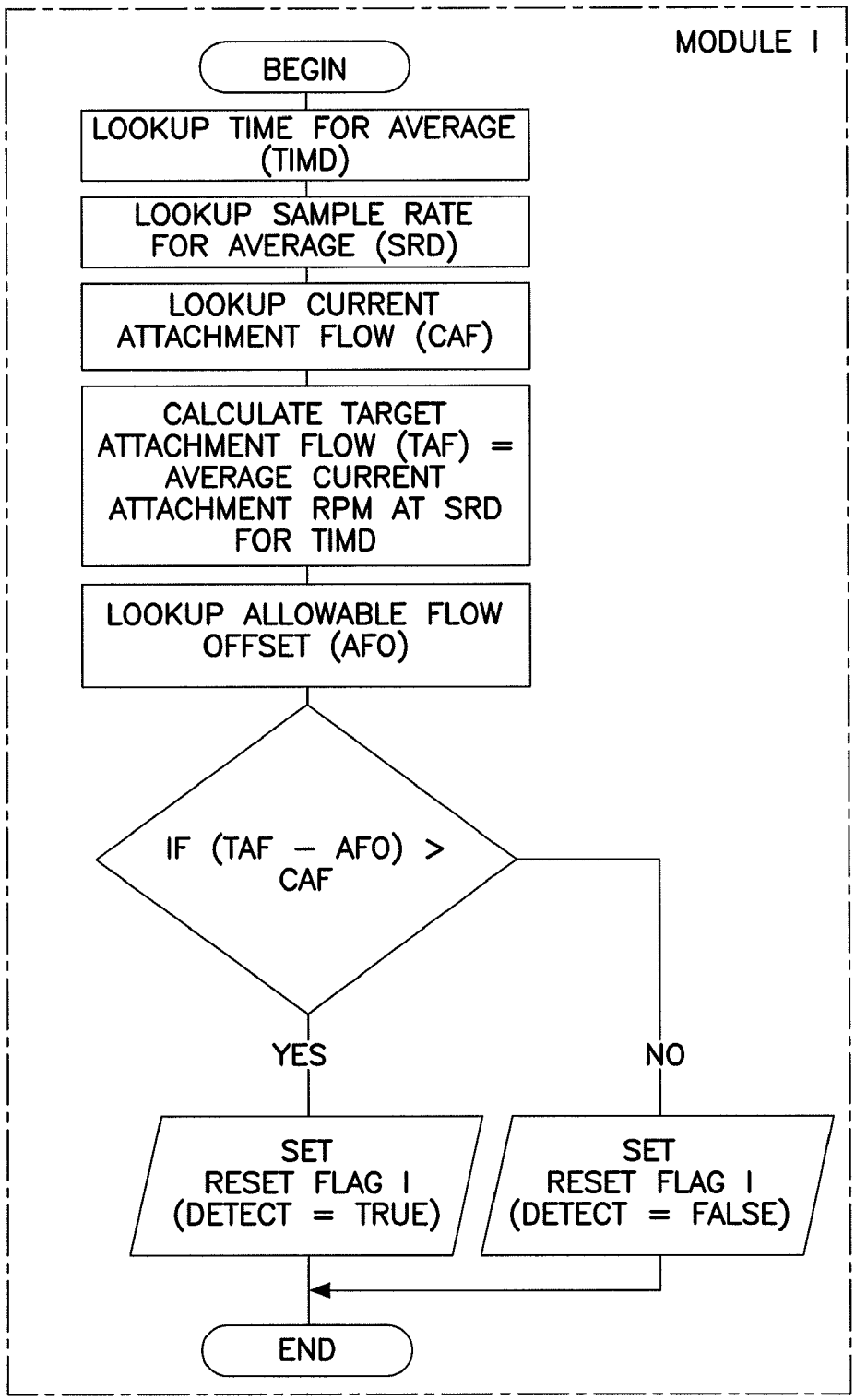
FIG. 12 is a block diagram of a flow based auto reverse exit condition according to an embodiment of the present disclosure.

Referring to FIG. 12, the system can be configured to resume normal operations based on hydraulic flow parameters. The configuration can be analogous to the configuration shown in FIG. 6 and described above. The system can be configured to sample the flow for a time period (TIMD) at a rate (SRD) to calculate the expected or target flow (TAF). The system is configured to determine (e.g., look up) an allowable flow offset (AFO) based on the target flow (TAF) and compare the current flow (CAF) to the target flow (TAF) minus the allowable flow offset (AFO). If the current flow (CAF) is less than target flow (TAF) minus the allowable flow offset (AFO), the system is reset and allowed to manually or automatically resume forward drive (absent an override); otherwise, the system is configured to wait longer for recovery. It should be appreciated that many other variations of the depicted flow based resume trigger conditions are possible.

Figure 13:
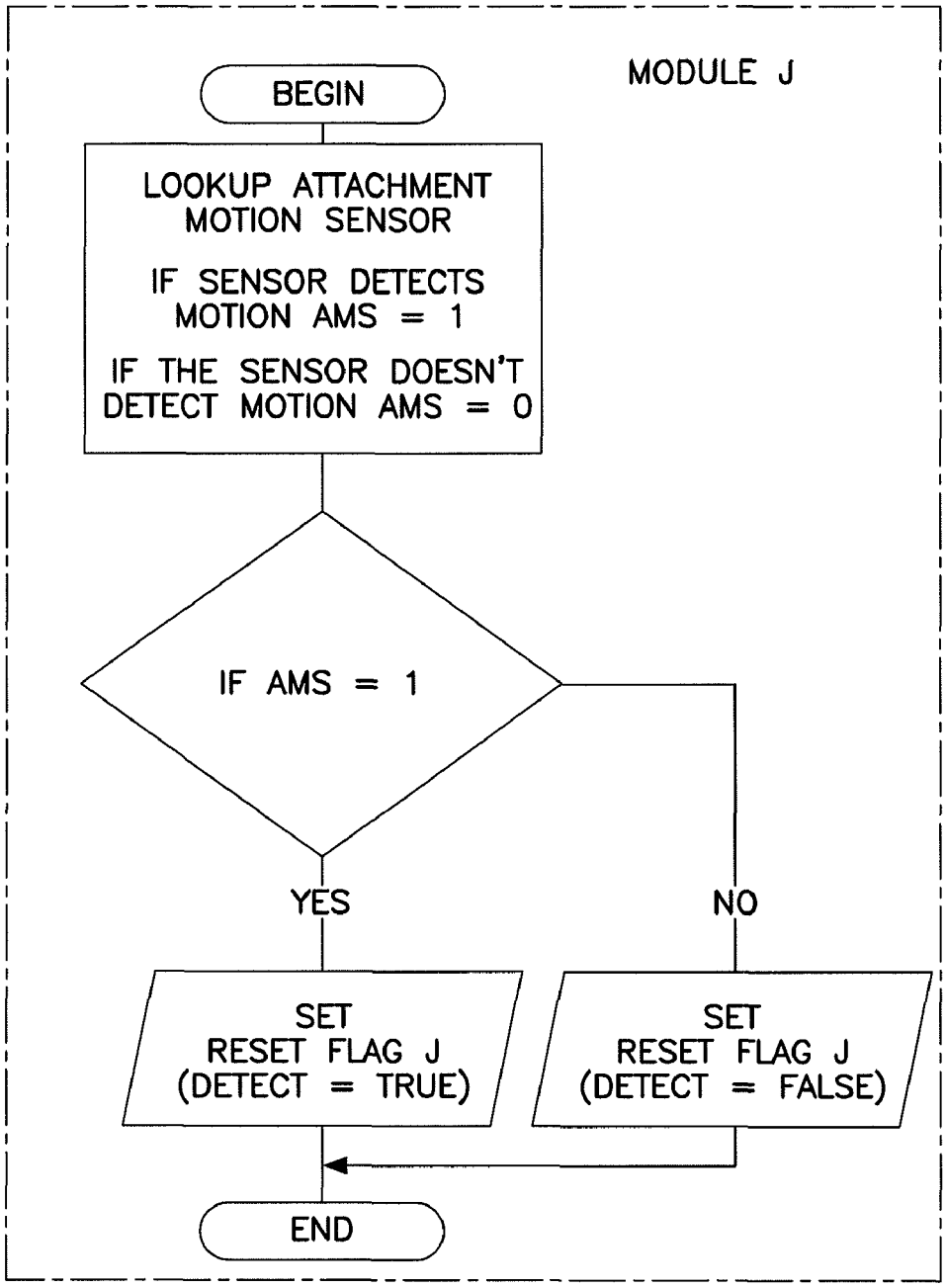
FIG. 13 is a block diagram of an excavation tool motion based auto reverse exit condition according to an embodiment of the present disclosure.

Referring to FIG. 13, the system can be configured to resume normal operations based on excavation tool motion parameters. The configuration can be analogous to the configuration shown in FIG. 7 and described above. In the depicted embodiment the system is configured to resume when the excavation tool is in motion. If the excavation tool is not in motion (when it should be in motion), the system waits for recovery (detect=false); otherwise, the automatic or manual forward control is enabled. It should be appreciated that many other variations of the excavation speed motion based resume trigger condition are possible.

Figure 14:
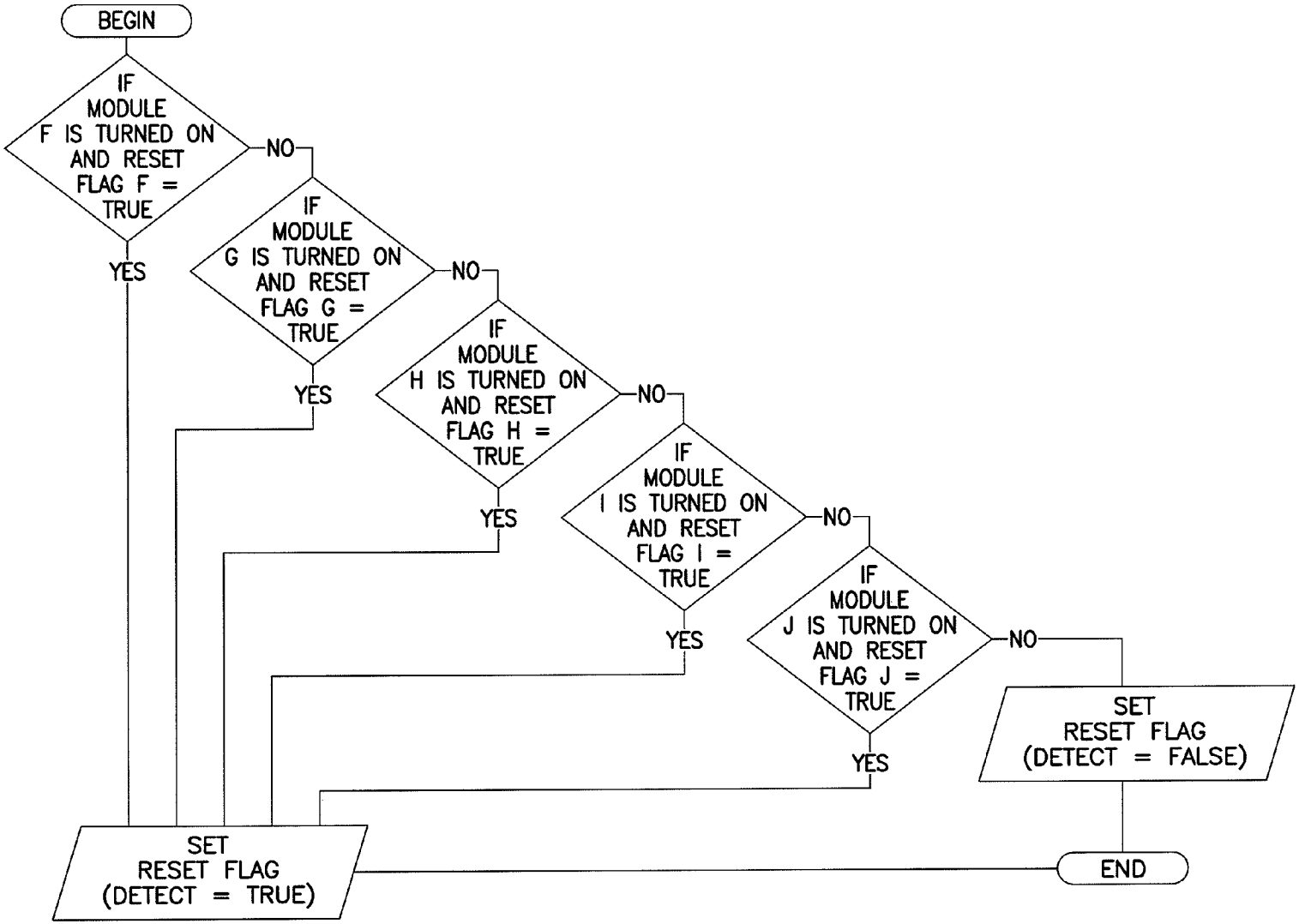
FIG. 14 is a block diagram of a multi-parameter based auto reverse exit condition according to an embodiment of the present disclosure.

Referring to FIG. 14, it should be appreciated that any one of the above parameters for triggering the resumption of the forward control system can be used alone or in combination with another configuration. FIG. 14 illustrates an embodiment wherein all of the above trigger conditions (engine speed based condition, excavation speed based condition, pressure based condition, flow based condition, and motion based condition) are used together such that the satisfaction of any one resumption condition will result in resuming forward controls.

Another step in the auto reverse sequence is resetting. In some embodiments after the ground drive has been automatically reversed, the machine drive is set to neutral; in other embodiments after the ground drive has been automatically reversed, the machine automatically resumes forward driving in an auto drive control mode; in other embodiments the machine automatically resumes forward driving in a manual control mode; in other embodiments the resetting depends on whether the excavation machine has determined if the condition (obstacle) that caused the triggering of the auto reverse sequence has been overcome or remains.

In some embodiments of the present disclosure, the control system is configured to determine when the employment of the auto reverse sequence has either resulted in the excavation machine overcoming a potential/actual jam-causing obstacle or has been stopped by the obstacle. Some of these embodiments include a control sequence that involves tracking/counting the number of times the auto reverse sequence is triggered. For example, the system can be configured to track the number of times the auto reverse sequence is triggered during a certain time period or within a certain distance. If the auto reverse sequence has not been triggered for a sufficiently long time or distance, the system determines that the obstacle is overcome and resets the counter. On the other hand, if the auto reverse sequence is triggered a large number of times within a certain distance or time period, the system determines the obstacle may be one that the excavation machine cannot move through without further intervention (e.g., reorientation of the excavation tool, driving the machine around the obstacle, etc.). An example configuration for determining whether an obstacle has been overcome is disclosed in U.S. Patent Application No. 61/248,217 filed on Oct. 2, 2009, which is incorporated herein by reference in its entirety.

Figure 15:
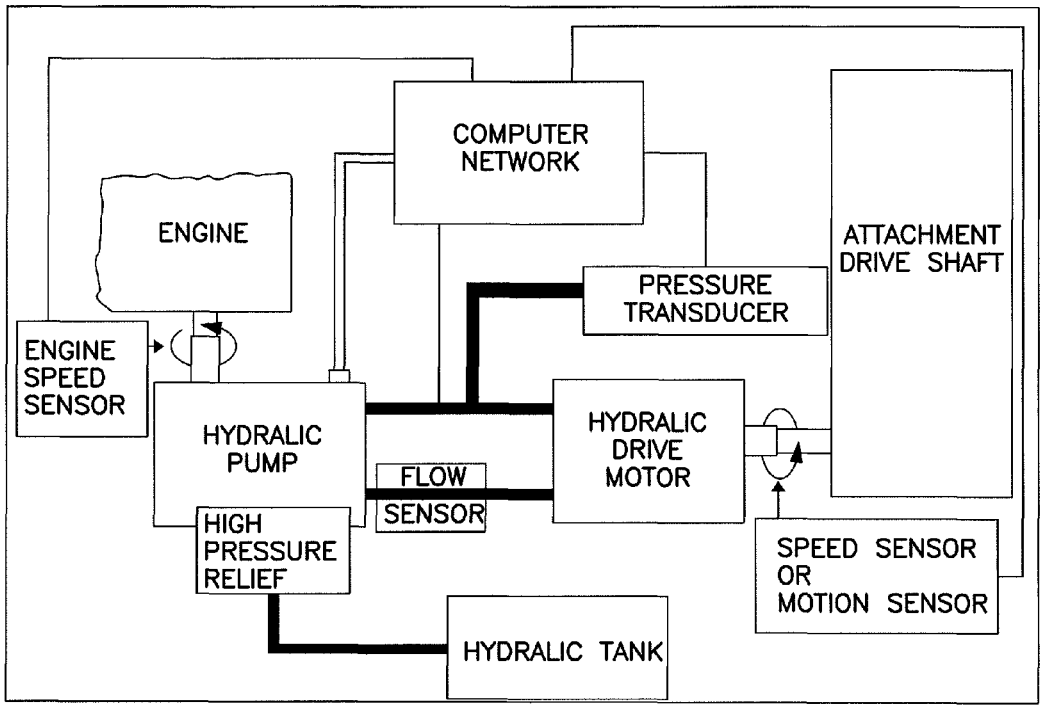
FIG. 15 is a schematic diagram of components of an excavation machine according to an embodiment of the present disclosure.

Referring to FIG. 15, components of an excavation machine of an embodiment of the present disclosure are shown. In the depicted embodiment, the excavation tool includes an engine that powers hydraulic pumps, which drive hydraulic motors. In the depicted embodiment, the hydraulic motors drive the ground drive (e.g., tracks) as well as an attachment/excavation tool. A number of sensors are provided including: an engine speed sensor, a pressure sensor, a flow sensor, and an excavation tool motion sensor and/or speed sensor. Each of the sensors is configured to send data to the computer network.

Figure 16:
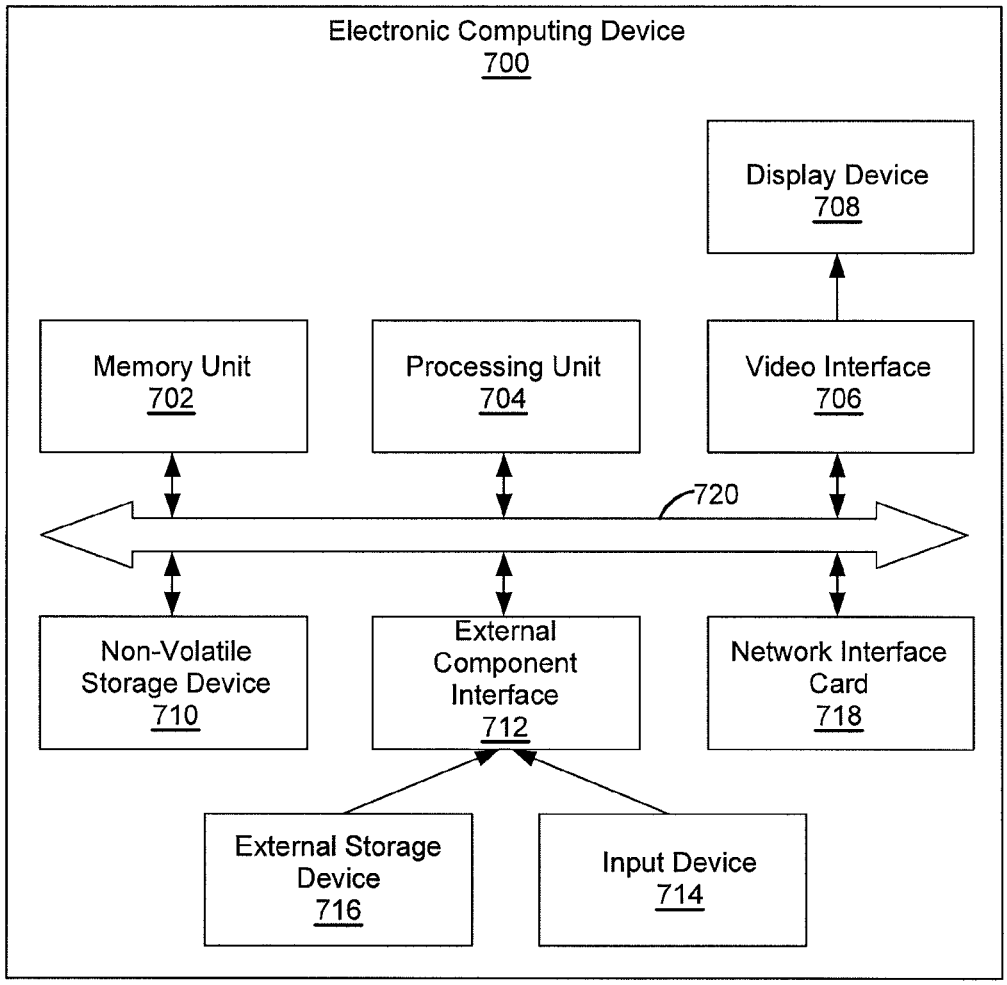
FIG. 16 is a schematic diagram of a computer network of the excavation machine of FIG. 15.

FIG. 16 is a block diagram illustrating example physical components of an electronic computing device 700, which can be used to execute the various operations described above, and can be any of a number of the devices described in FIG. 1 and including any of a number of types of communication interfaces as described herein. A computing device, such as electronic computing device 700, typically includes at least some form of computer-readable media. Computer readable media can be any available media that can be accessed by the electronic computing device 700. By way of example, and not limitation, computer-readable media might comprise computer storage media and communication media.

As illustrated in the example of FIG. 16, electronic computing device 700 comprises a memory unit 702. Memory unit 702 is a computer-readable data storage medium capable of storing data and/or instructions. Memory unit 702 may be a variety of different types of computer-readable storage media including, but not limited to, dynamic random access memory (DRAM), double data rate synchronous dynamic random access memory (DDR SDRAM), reduced latency DRAM, DDR2 SDRAM, DDR3 SDRAM, Rambus RAM, or other types of computer-readable storage media.

In addition, electronic computing device 700 comprises a processing unit 704. As mentioned above, a processing unit is a set of one or more physical electronic integrated circuits that are capable of executing instructions. In a first example, processing unit 704 may execute software instructions that cause electronic computing device 700 to provide specific functionality. In this first example, processing unit 704 may be implemented as one or more processing cores and/or as one or more separate microprocessors. For instance, in this first example, processing unit 704 may be implemented as one or more Intel Core 2 microprocessors. Processing unit 704 may be capable of executing instructions in an instruction set, such as the x86 instruction set, the POWER instruction set, a RISC instruction set, the SPARC instruction set, the IA-64 instruction set, the MIPS instruction set, or another instruction set. In a second example, processing unit 704 may be implemented as an ASIC that provides specific functionality. In a third example, processing unit 704 may provide specific functionality by using an ASIC and by executing software instructions.

Electronic computing device 700 also comprises a video interface 706. Video interface 706 enables electronic computing device 700 to output video information to a display device 708. Display device 708 may be a variety of different types of display devices. For instance, display device 708 may be a cathode-ray tube display, an LCD display panel, a plasma screen display panel, a touch-sensitive display panel, an LED array, or another type of display device.

In addition, electronic computing device 700 includes a non-volatile storage device 710. Non-volatile storage device 710 is a computer-readable data storage medium that is capable of storing data and/or instructions. Non-volatile storage device 710 may be a variety of different types of non-volatile storage devices. For example, non-volatile storage device 710 may be one or more hard disk drives, magnetic tape drives, CD-ROM drives, DVD-ROM drives, Blu-Ray disc drives, or other types of non-volatile storage devices.

Electronic computing device 700 also includes an external component interface 712 that enables electronic computing device 700 to communicate with external components. As illustrated in the example of FIG. 16, external component interface 712 enables electronic computing device 700 to communicate with an input device 714 and an external storage device 716. In one implementation of electronic computing device 700, external component interface 712 is a Universal Serial Bus (USB) interface. In other implementations of electronic computing device 700, electronic computing device 700 may include another type of interface that enables electronic computing device 700 to communicate with input devices and/or output devices. For instance, electronic computing device 700 may include a PS/2 interface. Input device 714 may be a variety of different types of devices including, but not limited to, keyboards, mice, trackballs, stylus input devices, touch pads, touch-sensitive display screens, or other types of input devices. External storage device 716 may be a variety of different types of computer-readable data storage media including magnetic tape, flash memory modules, magnetic disk drives, optical disc drives, and other computer-readable data storage media.

In the context of the electronic computing device 700, computer storage media includes volatile and nonvolatile, removable and non-removable media implemented in any method or technology for storage of information such as computer readable instructions, data structures, program modules or other data. Computer storage media includes, but is not limited to, various memory technologies listed above regarding memory unit 702, non-volatile storage device 710, or external storage device 716, as well as other RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and that can be accessed by the electronic computing device 700.

In addition, electronic computing device 700 includes a network interface card 718 that enables electronic computing device 700 to send data to and receive data from an electronic communication network. Network interface card 718 may be a variety of different types of network interface. For example, network interface card 718 may be an Ethernet interface, a token-ring network interface, a fiber optic network interface, a wireless network interface (e.g., WiFi, WiMax, etc.), or another type of network interface.

Electronic computing device 700 also includes a communications medium 720. Communications medium 720 facilitates communication among the various components of electronic computing device 700. Communications medium 720 may comprise one or more different types of communications media including, but not limited to, a PCI bus, a PCI Express bus, an accelerated graphics port (AGP) bus, an Infiniband interconnect, a serial Advanced Technology Attachment (ATA) interconnect, a parallel ATA interconnect, a Fiber Channel interconnect, a USB bus, a Small Computer System Interface (SCSI) interface, or another type of communications medium.

Communication media, such as communications medium 720, typically embody computer-readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media. Combinations of any of the above should also be included within the scope of computer-readable media. Computer-readable media may also be referred to as computer program product.

Electronic computing device 700 includes several computer-readable data storage media (i.e., memory unit 702, non-volatile storage device 710, and external storage device 716). Together, these computer-readable storage media may constitute a single data storage system. As discussed above, a data storage system is a set of one or more computer-readable data storage mediums. This data storage system may store instructions executable by processing unit 704. Activities described in the above description may result from the execution of the instructions stored on this data storage system. Thus, when this description says that a particular logical module performs a particular activity, such a statement may be interpreted to mean that instructions of the logical module, when executed by processing unit 704, cause electronic computing device 700 to perform the activity. In other words, when this description says that a particular logical module performs a particular activity, a reader may interpret such a statement to mean that the instructions configure electronic computing device 700 such that electronic computing device 700 performs the particular activity.

One of ordinary skill in the art will recognize that additional components, peripheral devices, communications interconnections and similar additional functionality may also be included within the electronic computing device 700 without departing from the spirit and scope of the present invention as recited within the attached claims.

The above specification, examples and data provide a complete description of the manufacture and use of the composition of the invention. For example, the principles of the present disclosure can be applied to many ride-on type machines that have a variety of attachments other than digger chains and rock wheels (e.g., plows, levers, drums, etc.). Since many embodiments of the invention can be made without departing from the spirit and scope of the invention, the invention resides in the claims hereinafter appended.

What is claimed is:

1. A method for excavating using an excavation machine, the excavation machine including a chassis supported on propulsion structures that are part of a ground drive system for propelling the chassis over a ground surface, the excavation machine also including an excavation attachment carried by the chassis, the excavation attachment including a digging tool driven by an attachment drive system, the digging tool including a plurality of cutting teeth, the excavation machine also including an actuator for raising and lowering the excavation attachment relative to the chassis, the method comprising:

performing an excavation operation by propelling the chassis in a forward direction over the ground with the ground drive system while driving the cutting teeth of the digging tool in a cutting motion with the attachment drive system;

detecting an auto reverse trigger condition with an electronic control system of the excavation machine;

triggering an auto reverse sequence with the electronic control system when the auto reverse trigger condition is detected, wherein the auto reverse sequence includes an action selected from the group consisting of: a) automatically reversing the ground drive system to move the chassis and the excavation attachment carried by the chassis in a reverse direction; and b) automatically reversing the attachment drive system to reverse the cutting motion of the cutting teeth of the digging tool.

2. The method of claim 1, wherein the auto reverse sequence includes automatically reversing the ground drive system to move the chassis and the excavation attachment carried by the chassis in the reverse direction.

3. The method of claim 1, where the auto reverse sequence includes automatically reversing the attachment drive system to reverse the cutting motion of the cutting teeth of the digging tool.

4. The method of claim 1, wherein the auto reverse sequence includes both automatically reversing the ground drive system to move the chassis and the excavation attachment carried by the chassis in the reverse direction and automatically reversing the attachment drive system to reverse the cutting motion of the cutting teeth of the digging tool.

5. The method of claim 1, wherein when the excavation operation is being performed, the cutting motion of the cutting teeth of the digging tool comprises rotation of the cutting teeth in a first rotational direction, and wherein when the attachment drive system is reversed the cutting teeth are moved in a second rotational direction that is opposite from the first rotational direction.

6. The method of claim 1, wherein the excavation machine comprises a trencher, wherein the excavation attachment comprises a trenching boom that is raised and lowered by the actuator, and wherein the digging tool comprises a digging chain that is rotated about the trenching boom by the attachment drive system.

7. The method of claim 6, wherein the digging chain is rotated in a first rotational direction about the trenching boom during excavation, and is rotated in a second rotational direction about the trenching boom when the attachment drive system is automatically reversed, the second rotational direction being opposite from the first rotational direction.

8. The method of claim 1, wherein the step of detecting an auto reverse trigger condition includes monitoring a parameter selected from the group consisting of rotational speed of a motor that drives the cutting teeth of the digging tool, speed of the cutting teeth relative to the chassis of the excavation machine, hydraulic pressure of a hydraulic system that drives the cutting teeth of the digging tool, and hydraulic flow of a hydraulic system that drives the cutting teeth of the digging tool.

9. A method for excavating using an excavation machine, the excavation machine including a chassis supported on propulsion structures that are part of a ground drive system for propelling the chassis over a ground surface, the excavation machine also including an excavation tool carried by the chassis, the excavation machine including an excavation tool drive system for rotating the excavation tool, the excavation tool being selected from the group consisting of a chain, a wheel, and a drum, the method comprising:

performing an excavation operation by engaging the excavation tool with material to be excavated while propelling the chassis in a forward direction over the ground with the ground drive system and while also driving the excavation tool in a first rotational direction with the excavation tool drive system;

detecting an auto reverse trigger condition with an electronic control system of the excavation machine;

triggering an auto reverse sequence with the electronic control system when the auto reverse trigger condition is detected, wherein the auto reverse sequence includes automatically reversing the excavation tool drive system to reverse a direction of rotation of the excavation tool from the first rotational direction to a second rotational direction that is opposite from the first rotational direction.

10. The method of claim 9, wherein the auto reverse sequence also includes automatically reversing the ground drive system to move the chassis and the excavation attachment carried by the chassis in a reverse direction.

11. The method of claim 9, wherein the step of detecting an auto reverse trigger condition includes monitoring a parameter selected from the group consisting of rotational speed of a motor that drives the excavation tool, speed of the excavation tool, hydraulic pressure of a hydraulic system that drives the excavation tool, and hydraulic flow of a hydraulic system that drives the excavation tool.

12. A method for excavating using an excavation machine, the excavation machine including a chassis supported on propulsion structures that are part of a ground drive system for propelling the chassis over a ground surface, the excavation machine also including an excavation tool carried by the chassis, the excavation machine including an excavation tool drive system for driving the excavation tool in a cutting motion, the method comprising:

performing an excavation operation by engaging the excavation tool with material to be excavated while propelling the chassis in a forward direction over the ground with the ground drive system and while also driving the excavation tool in the cutting motion with the excavation tool drive system;

detecting an auto reverse trigger condition with an electronic control system of the excavation machine;

triggering an auto reverse sequence with the electronic control system when the auto reverse trigger condition is detected, wherein the auto reverse sequence includes automatically reversing the ground drive system to move the chassis and the excavation tool carried by the chassis in a reverse direction.

13. The method of claim 12, wherein the step of detecting an auto reverse trigger condition includes monitoring a parameter selected from the group consisting of rotational speed of a motor that drives the excavation tool, speed of the excavation tool, hydraulic pressure of a hydraulic system that drives the excavation tool, and hydraulic flow of a hydraulic system that drives the excavation tool.

14. A method of excavation comprising:

engaging an excavation tool with material to be excavated;

moving the excavation tool relative to the material to be excavated by activating a ground drive; and triggering an auto reverse sequence based on the detection of an auto reverse trigger condition, wherein the auto reverse sequence includes automatically reversing the ground drive system.

15. The method of claim 14, wherein the step of engaging an excavation tool with the material to be excavated includes lowering the excavation tool to engage the ground.

16. The method of claim 14, wherein the detection of an auto reverse trigger condition includes monitoring an excavation tool speed.

17. The method of claim 16, wherein monitoring an excavation tool speed includes monitoring a rotational speed of a motor that drives the excavation tool.

18. The method of claim 17, wherein a rotational speed of a motor that drives the excavation tool includes monitoring the deceleration of the motor.

19. The method of claim 14, wherein the detection of an auto reverse trigger condition includes monitoring a hydraulic pressure.

20. The method of claim 19, wherein monitoring a hydraulic pressure includes monitoring the hydraulic pressure in a hydraulic system that drives movement of the excavation tool.

21. The method of claim 14, wherein the detection of an auto reverse trigger condition includes monitoring a hydraulic flow.

22. The method of claim 21, wherein monitoring a hydraulic flow includes monitoring the hydraulic flow in a hydraulic system that drives movement of the excavation tool.

23. The method of claim 14, further exiting an auto reverse sequence based on an auto reverse sequence exit trigger.

24. The method of claim 23, wherein the auto reverse sequence exit trigger is based at least in part on a set time interval.

25. The method of claim 23, wherein the auto reverse sequence exit trigger is based at least in part on a counter.

26. The method of claim 23, wherein the auto reverse sequence exit trigger is based at least in part on some of the same data that the auto reverse trigger condition is based on.

27. The method of claim 23, wherein the auto reverse sequence exit trigger is based at least in part on the speed of the excavation tool.

* * * * *